US009776838B2

(12) United States Patent
Sorensen et al.

(10) Patent No.: US 9,776,838 B2
(45) Date of Patent: Oct. 3, 2017

(54) CRANE MOTION CONTROL

(71) Applicant: PaR Systems, Inc., Shoreview, MN (US)

(72) Inventors: Khalid Lief Sorensen, Mableton, GA (US); William Singhose, Atlanta, GA (US)

(73) Assignee: PAR SYSTEMS, INC., Shoreview, MN (US)

( * ) Notice: Subject to any disclaimer, the term of this patent is extended or adjusted under 35 U.S.C. 154(b) by 0 days.

(21) Appl. No.: 14/815,338

(22) Filed: Jul. 31, 2015

(65) Prior Publication Data

US 2016/0031682 A1 Feb. 4, 2016

Related U.S. Application Data

(60) Provisional application No. 62/031,549, filed on Jul. 31, 2014.

(51) Int. Cl.
*B66C 13/06* (2006.01)
*B66C 13/18* (2006.01)

(52) U.S. Cl.
CPC ..... *B66C 13/18* (2013.01); *B66C 13/06* (2013.01)

(58) Field of Classification Search
None
See application file for complete search history.

(56) References Cited

U.S. PATENT DOCUMENTS 3,826,380 A * 7/1974 Lenander ..... B66C 13/063 212/273
4,273,243 A * 6/1981 Locher ..... B66C 13/08 212/273

(Continued)

FOREIGN PATENT DOCUMENTS

DE 19836103 A1 2/2000
DE 102007039408 A1 11/2008

(Continued)

OTHER PUBLICATIONS

International Search Report and Written Opinion for International patent application No. PCT/US0215/043200, dated Jan. 11, 2016.

*Primary Examiner* — Jonathan M Dager
(74) *Attorney, Agent, or Firm* — Steven M. Koehler; Westerman, Champlin & Koehler, P.A.

(57) ABSTRACT

Methods of detection and prevention for snags or off center lifts, and auto-centering a crane over a load. Snag detection includes monitoring angular deflection of the load with respect to an at-rest position, and halting movement of the crane in a direction of increasing angular deflection. Controlling off center lifting includes detecting a side load condition for a load, and preventing a hoist operation when the side load condition is detected. Auto-centering a load includes determining a position of a block coupled to the load with respect to a trolley of the crane, and centering the trolley over the block prior to a moving operation. Centering includes comparing a position of a block marker using a trolley camera to a known centered position of the marker with respect to the camera, and moving the trolley to match the determined position of the marker to its known centered position.

11 Claims, 4 Drawing Sheets

(56) References Cited

U.S. PATENT DOCUMENTS 4,281,342 A * 7/1981 Ueda ..... G01S 3/7864 348/94
4,471,877 A * 9/1984 Whitly ..... B66C 23/66 200/47
4,598,420 A 7/1986 Harvey
4,653,653 A * 3/1987 Scott ..... B66D 1/58 212/170
4,784,420 A * 11/1988 Makino ..... B66C 13/08 212/274
4,820,101 A * 4/1989 Fenn ..... G06Q 10/08 177/147
4,893,922 A * 1/1990 Eichweber ..... G01C 15/00 348/140
5,142,658 A * 8/1992 McMorran ..... B66C 13/46 180/167
5,440,476 A * 8/1995 Lefkowitz ..... G05B 19/251 212/76
5,463,463 A * 10/1995 Harvey ..... G01B 11/002 356/153
5,490,601 A * 2/1996 Heissat ..... G05D 19/02 212/275
5,491,549 A * 2/1996 Wichner ..... B66C 13/063 212/275
5,495,955 A * 3/1996 Shibata ..... B66C 13/063 212/275
5,526,946 A * 6/1996 Overton ..... B66C 13/063 212/275
5,532,824 A 7/1996 Harvey et al.
5,642,822 A * 7/1997 Monzen ..... B66C 13/46 212/275
5,754,672 A * 5/1998 Monzen ..... B66C 13/063 212/232
5,785,191 A * 7/1998 Feddema ..... B66C 13/063 212/275
5,806,695 A * 9/1998 Hytonen ..... B66C 13/063 212/270
5,823,369 A * 10/1998 Kuromoto ..... B25J 9/1638 212/223
5,878,896 A * 3/1999 Eudier ..... B66C 13/063 212/270
5,898,746 A * 4/1999 Baversten ..... B66C 13/063 212/273
5,909,817 A * 6/1999 Wallace, Jr. ..... B66C 19/002 212/270
5,917,600 A 6/1999 Rongo et al.
5,960,969 A * 10/1999 Habisohn ..... B66C 13/063 212/270
5,961,563 A * 10/1999 Overton ..... B66C 13/063 212/272
6,050,429 A * 4/2000 Habisohn ..... B66C 13/063 212/270
6,124,932 A 9/2000 Tax
6,126,023 A * 10/2000 Durrant-Whyte ..... B66C 13/06 212/274
6,135,301 A * 10/2000 Monzen ..... B66C 13/06 212/272
6,145,680 A 11/2000 Jussila
6,182,843 B1 2/2001 Tax
6,229,473 B1 * 5/2001 Doemens ..... B66C 13/063 324/642
6,241,462 B1 * 6/2001 Wannasuphoprasit ... B66D 3/18 212/283
6,256,553 B1 * 7/2001 Erikkila ..... B66C 13/063 212/284
6,343,703 B1 * 2/2002 Fleagle ..... B66C 13/46 212/276
6,351,720 B1 * 2/2002 Hoshina ..... G01B 11/00 352/243
6,377,186 B1 * 4/2002 Dunne ..... B66C 13/46 340/3.43
6,460,711 B1 * 10/2002 Kato ..... B66C 13/063 212/275
6,496,765 B1 * 12/2002 Robinett, III ..... B66C 13/063 212/272
6,588,610 B2 * 7/2003 Ong ..... B66C 13/063 212/270
6,826,452 B1 * 11/2004 Holland ..... B66C 1/663 318/566
7,040,496 B2 * 5/2006 Hakala ..... B66C 13/06 212/274
7,121,012 B2 * 10/2006 Voecks ..... G01C 9/16 33/345
7,123,132 B2 10/2006 Heidenback
7,137,771 B2 * 11/2006 Maurer ..... B66C 13/085 212/274
7,289,875 B2 10/2007 Recktenwald et al.
7,331,477 B2 2/2008 Schulte
7,428,781 B2 * 9/2008 Wickhart ..... B61K 9/08 33/1 BB
7,599,762 B2 * 10/2009 Discenzo ..... B66C 13/063 701/1
7,936,143 B2 * 5/2011 Ikeguchi ..... B66C 13/063 212/272
7,950,539 B2 5/2011 Henriksson
8,267,264 B2 9/2012 Bryfors et al.
8,352,128 B2 * 1/2013 Stocker ..... B66C 13/46 212/272
9,120,653 B2 * 9/2015 Bohnacker ..... B66C 13/46
9,156,167 B2 * 10/2015 Cameron ..... B25J 9/1676
9,321,614 B2 * 4/2016 Moran ..... B66C 13/063
2002/0024598 A1 * 2/2002 Kunimitsu ..... B66C 13/46 348/159
2003/0136752 A1 * 7/2003 Lee ..... B66C 13/10 212/323
2004/0026349 A1 * 2/2004 Colgate ..... B66D 3/18 212/284
2004/0149056 A1 * 8/2004 Lukas ..... B66C 13/063 73/865.9
2004/0164041 A1 * 8/2004 Sawodny ..... B66C 13/085 212/273
2005/0016005 A1 1/2005 Voecks
2005/0103738 A1 * 5/2005 Recktenwald ..... B25J 9/1638 212/275
2005/0224438 A1 * 10/2005 Maurer ..... B66C 13/063 212/274
2005/0232626 A1 * 10/2005 Schulte ..... B66C 13/46 396/515
2005/0242052 A1 * 11/2005 O'Connor ..... B66C 19/007 212/344
2005/0281644 A1 * 12/2005 Lussen ..... B66C 13/46 414/403
2007/0023377 A1 * 2/2007 Abel ..... B66C 23/88 212/270
2007/0081695 A1 * 4/2007 Foxlin ..... G06T 7/73 382/103
2007/0289931 A1 * 12/2007 Henriksson ..... B66C 13/063 212/274
2009/0008351 A1 * 1/2009 Schneider ..... B66C 13/063 212/272
2009/0326718 A1 * 12/2009 Bryfors ..... B66C 13/46 700/275
2012/0168397 A1 * 7/2012 Lim ..... B66D 3/18 212/273
2014/0100693 A1 * 4/2014 Fong ..... G05D 1/0274 700/253
2014/0224755 A1 * 8/2014 Eriksson ..... B66C 13/06 212/273

FOREIGN PATENT DOCUMENTS

JP H1017268 A 1/1998
JP 2003267660 A 9/2003
WO 9219526 A1 11/1992
WO 2009138329 A1 11/2009
WO 2013041770 A1 3/2013

* cited by examiner

CRANE MOTION CONTROL

CROSS REFERENCE TO RELATED APPLICATION

This application claims the benefit of U.S. Provisional Application No. 62/031,549, filed on Jul. 31, 2014, hereby incorporated herein in its entirety by reference.

FIELD

Aspects of the present disclosure relate to crane and/or hoist systems, and in particular to control or augmentation of crane and/or hoist systems.

BACKGROUND

In some hoisting situations, it is difficult for a crane operator to determine if a crane is directly over the top of a load that is to be moved. In a side load situation, the crane is not directly over the point at which the hook/bottom block is attached to the load. Instead the bottom block may be offset horizontally some amount from its at-rest position. For example, suppose an operator intends to lift a load resting on the ground. If, after attaching the crane's hook to the load, the hook is displaced twelve inches to the side of its at-rest position, then when the operator hoists the load and the load leaves the ground, it may begin to swing. Loads can exceed 100,000 pounds, and can be very large as well. Swinging loads are hazardous because they can cause a number of potential issues, including cable damage creating a risk of cable breakage; damage to the load from impacting surrounding objects; damage to other loads or infrastructure; or injury or death to personnel on the ground hit or crushed by a swinging load.

If the hook is not correctly positioned over the load prior to hoisting, then the crane operator will often attempt to adjust the position of the crane so that the hook is vertically centered over the load, i.e., the hook is directly over the top of the center of gravity of the load. However, as has been mentioned, it is often difficult for an operator to determine if a hook is directly aligned above the load center. Even a small deviation from center can cause issues such as those described above.

In some situations, once a load has been moved, the crane is then moved to a different location. If an operator of the crane or ground personnel fail to ensure that the hook is disconnected from the load or the rigging, or fail to notice that the motion of the crane will take the hook into or through an area that has obstacles, a hook can snag. When a hook snags, motion of the hook can become unpredictable, and can lead to damage to the crane, cables, hook, and can cause serious injury or death, especially if the hook snags and drags something heavy or breakable.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

In one embodiment, a method of augmenting a lifting operation for a crane includes detecting a side load condition for a load to be moved by the crane, and preventing a hoist operation when the side load condition is detected.

In another embodiment, a method of snag detection for a load to be moved with a crane includes monitoring an angular deflection of the load with respect to an at-rest position of the load, and halting movement of the crane in a direction that results in an increasing angular deflection.

In another embodiment, a method of auto-centering a load to be moved with a crane includes determining a position of a block coupled to the load with respect to a trolley of the crane, and centering the trolley over the block prior to a moving operation. Centering includes in one embodiment comparing a position of a fiducial marker associated with the block using a camera associated with the trolley to a known centered position of the fiducial marker with respect to the camera, and moving the trolley to match the determined position of the fiducial marker to the known centered position of the fiducial marker.

In another embodiment, a crane motion detection system includes a camera configured to mount on a trolley of the crane, a fiducial marker configured to mount on a hook of the crane within a field of view of the camera, and a controller coupled to the camera to receive and process images from the camera, and coupled to the trolley to control operation of the trolley in response to processed images. The controller in one embodiment controls operation to at least one of detecting and preventing off center lifts of a load, detecting and preventing snagging of a load, and auto-centering the crane over a load as described in other embodiments herein.

DETAILED DESCRIPTION

Figure 1:
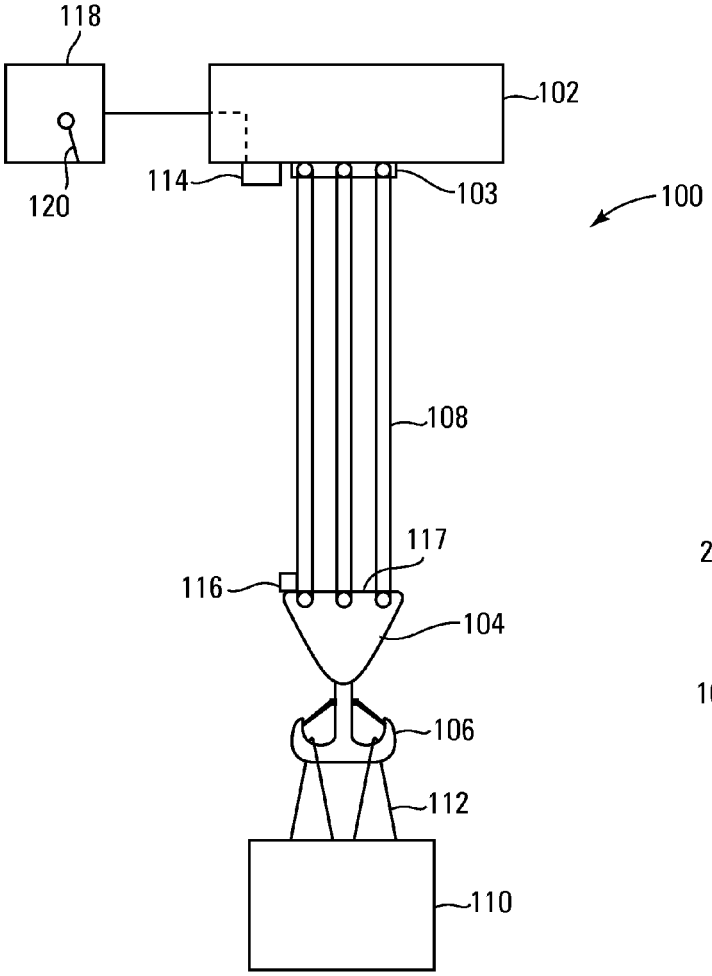
FIG. 1 is a diagrammatic view of a crane and motion control system according to an embodiment of the present disclosure.

Embodiments of the present disclosure provide motion control systems for industrial cranes including, for example only and not by way of limitation, heavy equipment production cranes, primary metals coil cranes, general purpose single and double girder bridge cranes, and the like. Side load detection, auto load centering, and snag detection are some of the motion controls provided by embodiments of the present disclosure.

Camera-based crane manipulation and control may increase safety and may simplify hoisting tasks. Embodiments of the disclosure include a camera mounted to a crane in a position to be able to image a fiducial marker having a fiducial pattern thereon that is mounted to a hook/bottom block of the crane in a position so as to be visible in the field of view of the camera. With the image of the hook/bottom block of the crane, a controller, such as a programmable logic controller (PLC) is used to interpret data from the image to detect and in some cases correct issues with crane loading. Such issues include by way of example only and not by way of limitation, side load detection, auto load centering, and snag detection. In general, adverse cable angles may be detected against a threshold, such as an angular deflection of a fixed value, a hoist length, a distance of the block from an image capture element mounted on a trolley of the crane, or the like. A control response may be initiated, or a warning may be issued, following the detection.

Sensory information about hook position is obtained using the camera, such as an industrial machine vision digital camera in one embodiment, together with software, firmware and/or hardware such as a programmable logic controller (PLC) to control operation of a crane, specifically, of the motion of a crane. The camera is in one embodiment mounted on a crane trolley, near a cable drum, oriented downward toward a typical at-rest position for the hook. In this configuration, the hook is visible to the camera. The camera captures and analyzes in one embodiment 20 images of the hook including the fiducial marker per second. Hook position information is determined by the controller using the images and known functions relating to the fiducial marker, as described further below. In this disclosure, the terms hook and bottom block may be used interchangeably, as known in the field.

To facilitate reliable hook tracking, in one embodiment, the fiducial marker comprises a pattern of retro-reflective fiducial markers fastened to the hook. Fiducial markers are easily discernable from the other features in the workspace. They permit the camera to track the hook consistently and accurately. While retro-reflective fiducial markers are described herein, it should be understood that any fiducial marker capable of being imaged by the camera is amenable to use with the embodiments of the present disclosure without departing from the scope of the disclosure.

Embodiments of the present disclosure mount an industrial camera to a crane, mount fiducial markers on a bottom block or hook of the crane within the field of view of the camera, and determine with a controller an angular or horizontal displacement of the hook from its at-rest position, using images taken by the camera of the fiducial markers. With that information, the controller may be used in some embodiments to implement control restrictions on the crane or implement crane movement to correct the angular displacement, or issue warning(s) to the crane operator.

Referring to FIG. 1, a diagrammatic view of a crane 100 is shown. Crane 100 is shown generally, but it should be understood that crane 100 can comprise any number of overhead crane types such as single and double girder bridge cranes, and the like. Crane 100 comprises in one embodiment crane body 102 which can comprise a set of parallel runways with a traveling bridge spanning the gap and movable in a direction parallel with the runways, and a trolley movable laterally along the bridge (i.e., perpendicular to the runways), or the like, as are known in the art. A hoist 103 travels along the trolley, and supports a bottom block 104 and hook 106 using cabling 108. The crane 100 is used to hoist or move a load 110 rigged to the hook 106 through rigging 112, such as cables or the like. An imaging system 114 (in one embodiment a digital camera such as an industrial machine vision camera or the like) is mounted to the crane body 102 (such as to the trolley or hoist 103) in a position so as to place fiducial marker 116, which is mounted to the bottom block 104 or hook 106, visible in its image field of view.

Figure 2:
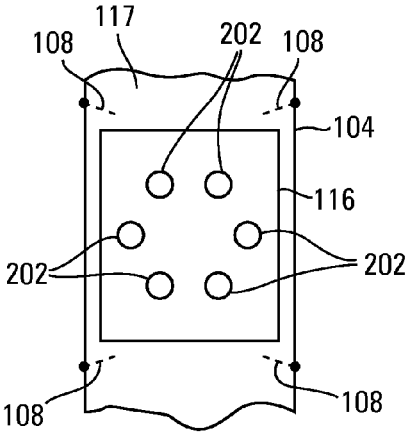
FIG. 2 is a top view of a portion of a bottom block of FIG. 1.

Fiducial marker 116 in one embodiment comprises a fiducial with a plurality of retro-reflective fiducial markers 202 thereon, as shown in top view in FIG. 2. Retro-reflective marker 116 is shown mounted to a top surface 117 of bottom block 104. However, it should be understood that retro-reflective marker 116 may be mounted in a different position on the bottom block 104 or to the hook 106, provided that it is visible to the field of view of camera 114. Also, camera 114 may be mounted in a different position on the crane body 102 so long as the retro-reflective marker 116 is visible in the field of view of the camera 114 during operation. Although a series of six round retro-reflective fiducial markers 202 arranged in a particular pattern are shown, it should be understood that different fiducial patterns or quantity of fiducials may be used in embodiments of the present disclosure without departing from the scope of the disclosure.

Figure 3:
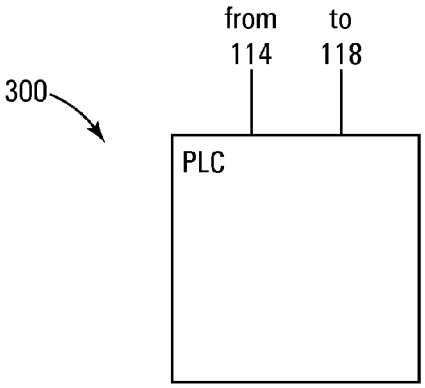
FIG. 3 is a block diagram of a controller according to an embodiment of the present disclosure.

Referring also to FIG. 3, camera 114 is connected in one embodiment to a controller 300 that analyzes images from the camera 114 to determine position of the hook 106 and/or bottom block 104. In another embodiment, the camera includes processing power sufficient to analyze the images to determine position of the hook, and reports this result to the controller. In this embodiment, the camera is a "smart" camera. It has image taking capabilities and image processing capabilities. The results of the processing are issued to the PLC. In an at-rest position, that is, with the bottom block and hook in a substantially static position free hanging on the cables 108 from the crane body 102, the camera 114 takes an image including the retro-reflective marker 116, and conveys the image to the controller 300, or processes the image itself. Controller 300 or camera determines the position of the bottom block 104 and hook 106 relative to its at-rest position by determining the position of the retro-reflective marker 116 relative to its at-rest position (see below). Position parameters include in some embodiments position within the field of view of the camera 114 and/or a distance of the bottom block 104 or hook 106 from the camera 114, and may be determined as described below. Communication between camera 114, controller 300, and crane controls 120 at operator location 118 may be accomplished over one or more of a number of connections, including by way of example only and not by way of limitation, wired connections, wireless connections, or a combination thereof.

Figure 4:
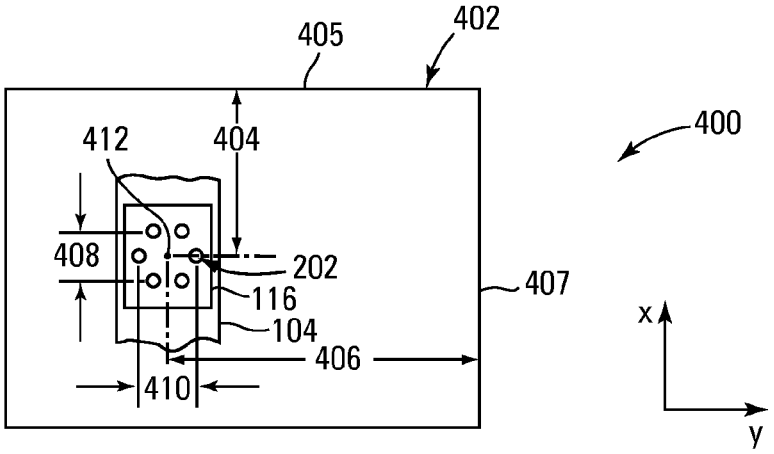
FIG. 4 is a representative view of a camera image according to an embodiment of the present disclosure.

Referring now also to FIG. 4, in one embodiment, this determination of position of the retro-reflective marker 116 is made using an image 400 provided to the controller 300. As is seen in FIG. 4, image 400 occupies a specific area 402, which may be a display or portion of a display, or any known dimension area (such as a number of pixels wide and a number of pixels deep, or the like). The centroid location 412 of the fiducial markers 202 on retro-reflective marker 116 may be expressed with respect to the image 400 as a particular number of pixels 404 from a top edge 405 of the image 400, and a particular number of pixels 406 from a right side edge 407 of the image 400. The location of the bottom block 104 in one embodiment may therefore be determined by reference to the number of pixels 404 and 406, and a centroid 412 of the retro-reflective marker 116 may also be determined. The centroid will have a coordinate of 404, 406 as determined from the top 405 and right 407 of the image 400 which constitutes the field of view of the camera 114. It should be understood that the coordinates may be with respect to any point within the field of view of the camera 114, and can be expressed in a number of different units other than pixels as described herein, as embodied in the image without departing from the scope of the disclosure.

Normally, operations of a crane such as crane 100 are controlled by an operator in a cab or operator location 118 using controls 120 (simplified for purposes of this disclosure). The crane operator uses the controls 120 to perform operations including hoist operations, traverse operations, and the like, as are known in the art. Typically, an operator and another person or persons responsible for a load on the crane work in combination to rig the load in preparation for crane operations. Rigging can be difficult, especially for very large loads, or for loads that are not uniform or symmetric. Despite experience and skill of riggers and crane operators, nevertheless, loads can be improperly rigged, leading to potentially very dangerous situations in which loads can shift, be side pulled, tip, or the like.

Figure 5A:
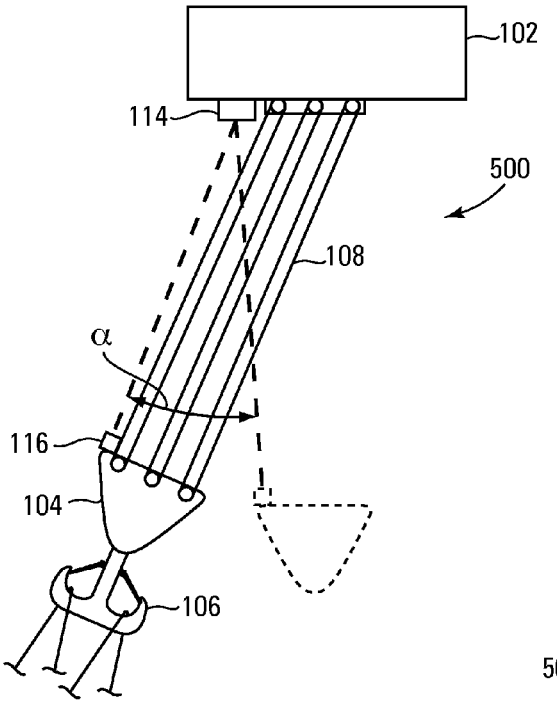
FIGS. 5A and 5B are diagrammatic views of a crane with bottom block in at-rest and angularly displaced configurations.
Figure 5B:
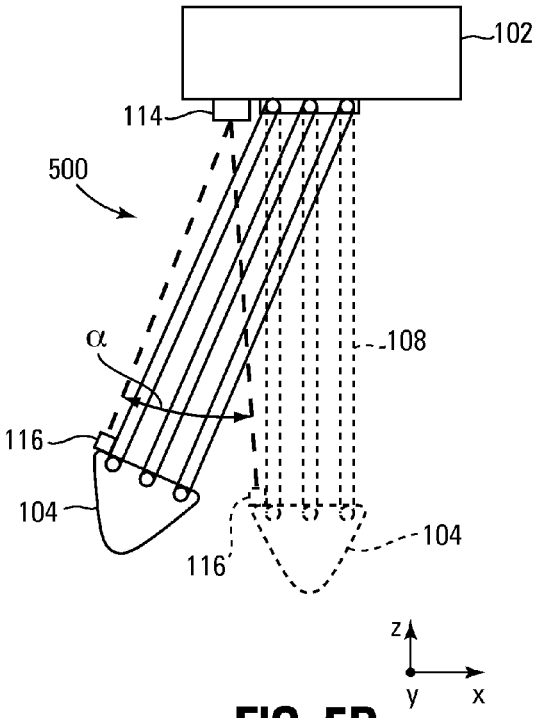

For example, when bottom block 104 (and hook 106) are coupled to a load such as load 110 as shown in FIG. 1, a condition known as side-loading may occur. Side-loading can lead to side pull lifts, which can cause serious consequences for loads, cranes, and personnel, as described above. An example of a side loading condition is shown in diagrammatic form in FIGS. 5A and 5B. A rest position of a bottom block 104 coupled to crane body 102 with cables 108 is shown in dashed lines, and a side loaded position of bottom block 104 coupled to crane body 102 with cables 108 is shown in solid lines. As may be seen, the bottom block 104 is displaced from its at-rest position by an angle $\alpha$ with respect to its at-rest position. A determination of this side-load angle $\alpha$ may be made in one embodiment using an image (such as image 400) of the bottom block 104 in its rest position versus an image of the bottom block 104 in its current position, that is, a position in which the crane 100 is ready for a hoist operation (as shown in FIG. 6).

Figure 6:
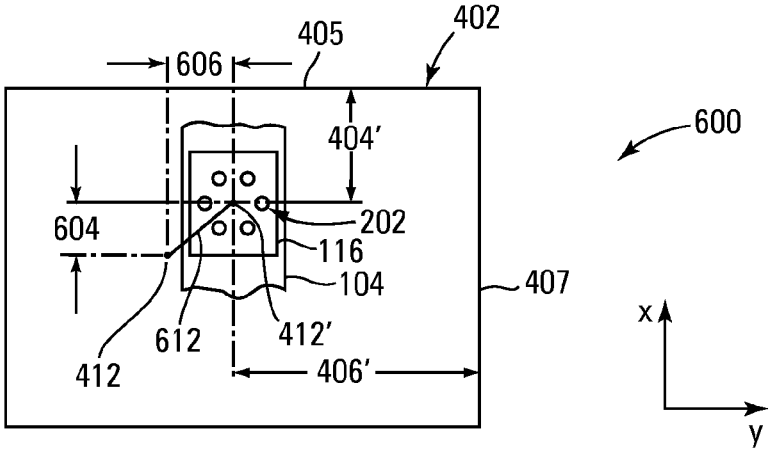
FIG. 6 is a representative view of a camera image according to another embodiment of the present disclosure.

Referring now also to FIG. 6, representative image 600 including bottom block 104 and its retro-reflective marker 116 in a side-loaded position such as that shown in FIG. 5 and taken by a camera such as camera 114 is shown. In the image 600, retro-reflective marker 116 is in a different position than its at-rest position as shown in FIG. 4. The bottom block 104 and consequently the retro-reflective marker 116 have moved from their at-rest positions by a distance in the x-direction by an amount of pixels 604 and in the y-direction by an amount of pixels 606. The centroid position 412' of the bottom block 104 and retro-reflective marker 116 is determined in this embodiment again using the fiducial markers 202. The centroid location 412' of the fiducial markers 202 on retro-reflective marker 116 may be expressed with respect to the image 600 as a particular number of pixels 404' from a top edge 405 of the image 600, and a particular number of pixels 406' from a right side edge 407 of the image 600. The location of the bottom block 104 in one embodiment may therefore be determined by reference to the number of pixels 404' and 406', and a centroid 412' of the retro-reflective marker 116 may also be determined. The centroid 412' will have a coordinate of 404, 406 as determined from the top 405 and right 407 of the image 600 which constitutes the field of view of the camera 114. The bottom block 104 is therefore side-loaded in FIG. 6 by an amount that may be determined using the images 600 and 400, by determining the distance 612 in pixels between the centroid locations 412 and 412'. Based on the camera lens and camera characteristics, a simple conversion between a number of pixels and an angle is used to determine the angle $\alpha$ between the centroid positions 412 and 412'.

In one embodiment, when the controller 300 determines that a load (such as load 110) on the hook is side-loaded by an angle greater than a determined, settable and adjustable threshold, the controller 300 disallows any hoisting operation. That is, even if a crane operator uses the controls 120 to initiate a hoist operation, the controller 300 disables the hoisting operation. In one embodiment, a signal is sent from the controller 300 to crane controls 120 that disables the hoisting operation. Hoisting operation may be re-enabled when the side-loading is corrected to an angle below the threshold. The threshold angle of acceptable side-loading may be set based on the load, the crane, the conditions, or some combination thereof.

When camera 114 captures an image of the bottom block 104 in its field of view, the image may be transmitted to the controller 300, and the controller 300 uses that image, along with the known function and base images of the bottom block 104 in its at-rest position for the distance between the camera 114 and the bottom block 104 (described in detail below), to determine an angular displacement of the bottom block 104 from its at-rest position. Alternatively, the camera may capture the image and process it internally to determine the current angular displacement. Then, this value is transmitted to the controller. The angular displacement threshold at which hoisting is prevented may be in one embodiment a function of one or more of the load characteristics and the distance between the camera and the bottom block. In one embodiment, when the bottom block 104 is higher, that is, when the distance between the camera 114 and the bottom block 104 is smaller, the allowable angular displacement may be larger than when the distance between the camera 114 and the bottom block 104 is larger. In one embodiment, the controller 300 is programmed to determine the distance between the camera 114 and the bottom block 104 (described below with reference to FIG. 7) and consult a table of the threshold angle $\alpha$ of angular displacement allowed before preventing hoisting operations.

Referring again to FIGS. 4 and 6, one embodiment of the present disclosure provides for auto-centering of a load. Side load hoisting prevention is concerned with preventing a hoisting operation if there is a side-loading exceeding a certain predetermined angle. Auto-centering uses images of a bottom block 104 and hook 106 in an at-rest position (as shown at 400 in FIG. 4) and of the bottom block 104 and hook 106 in a loaded condition potentially ready for hoisting (as shown at 600 in FIG. 6) to adjust the position of the bottom block 104 and hook 106 to place the bottom block 104 and hook 106 in the at-rest position of the bottom block 104 and hook 106 before operation. This may be done automatically by an operator engaging auto-centering such as by selection of auto-centering via controls 120. In another embodiment, auto-centering may be set to activate when a hoisting operation is initiated by an operator.

To accomplish this, the component pixel distances used for determining an angle $\alpha$ of side-loading may be used for auto-centering. Specifically, FIG. 4 shows an image 400 of a bottom block 104 and the retro-reflective marker 116 thereon. The centroid 412 of the fiducial markers 202 of the retro-reflective marker 116 is identified as a number of pixels 404 from a top 405 of the image 400 and a number of pixels 406 from a right side 407 of the image 400. FIG. 6 shows an image 600 of the bottom block 104 and retro-reflective marker 116 thereon. The centroid of the fiducial markers 202 of the retro-reflective marker 116 has moved, and is now at a centroid location identified as 412' which is a number of pixels 404' from a top 405 of the image 600 and a number of pixels 406' from a right edge 407 of the image 600. This correlates to a difference of a number of pixels 604 in the x-direction and a number of pixels 606 in the y-direction, as indicated by the axis legend of the figures. As the speed of current cameras allows for imaging at a speed of at least 20 frames per second, corrective movement can be made essentially in real time, as follows.

If the bottom block 104 is off center with respect to its at-rest position in either or both of the x- or y-directions beyond a certain threshold, in an auto-centering operation, the crane 100 automatically moves the bottom block 104 to center the bottom block 104 on its at-rest position. Movement of the crane provides independent movement in each of the x- and y-directions. In one embodiment, the controller 300 determines the number of pixels 604 from the at-rest position the bottom block 104 is in the x-direction, and determines the number of pixels 606 from the at-rest position the bottom block 104 is in the y-direction, and initiates movement of the crane toward the at-rest position in each of the x- and y-directions. To move the bottom block 104 toward its at-rest position in one embodiment, the controller 300 initiates control of the crane to move the bottom block 104 toward its at-rest position in the x-direction, and initiates control of the crane to move the bottom block 104 toward its at-rest position in the y-direction. In one embodiment, the movement of the crane is at its minimum speed to avoid, or at a speed suitable to prevent or reduce, unnecessary oscillation or swaying (i.e., overshoot) of the bottom block 104 and hook 106. For each axis of motion, in this embodiment along the x-direction of movement and along the y-direction of movement, the pixel difference between the off-center position (as shown in image 600) and the at-rest position (as shown in image 400) is determined by subsequent images in the same fashion as described above. Once the displacement of the bottom block 104 changes sign on a particular axis, motion in that direction is stopped by the controller 300. Additionally, motion may also be stopped when the angular displacement is less than a predetermined, settable amount, or when auto-centering has been active for a specified duration.

One corrective motion for each axis is used in one embodiment so as to avoid potential oscillation of the bottom block 104 and hook 106 that might be caused by multiple corrections or continuous corrections. One motion is enabled as follows. Once a position 404',406' is determined, motion toward the at-rest position 404,406 is initiated in auto-centering. In the x-direction, a number of pixels 604 is the difference between 404' and 404. Movement of the crane in the x-direction is performed while the controller monitors the current position with respect to the at-rest position. As the determined difference 604 between 404' and 404 shrinks, it eventually gets to 0 and then to −1 pixel. At this point, the displacement is considered to have changed signs, and motion on the x-axis is stopped. The same operation occurs for the corrective motion in the y-direction. Corrective action along the axes is independent. Alternatively, auto-centering is stopped in another embodiment when the angle is less than a specified threshold for a finite duration, or if auto-centering action has been active for a specified duration. This is especially useful in systems where the angle may not change sign. These methods may be implemented independently or simultaneously.

Oscillation may also be induced when motion of the crane is at a variable speed, such as proportional control. In a proportional control scheme, a high velocity is used at a start of a corrective motion, and as the distance to be corrected decreases, the speed of motion also decrease. Embodiments of the present disclosure may use proportional control for corrective motion, but motion at a constant minimum speed of the crane with only one corrective motion per axis is used in one embodiment. If more than one corrective motion is used, that may induce limit cycling and constant correction that may make a situation worse.

A distance from the camera 114 to the retro-reflective marker 116 may be determined in one embodiment without distance sensors using a known distance function determined by a size of the retro-reflective marker at various known distances from the camera such as may be determined in calibration of the camera. A closed form function may be determined allowing the controller 300 to determine where in the field of view of the camera the at-rest position of the bottom block 104 is for all distances from the camera 114 to the bottom block 104.

For example, the closer the retro-reflective marker 116 is to the camera, the larger it appears in an image taken by the camera. So, once the function of distance from the camera 114 to retro-reflective marker 116 is determined, the controller 300 simply determines the size of the retro-reflective marker 116, compares it to the function or known size parameters, and determines the distance of the retro-reflective marker 116 from the camera 114. From that distance, the at-rest position for the hook is known at any distance from the camera 114, without using distance sensors. In another embodiment, a hoist length sensor may be used. In such a configuration, hoist length data from the hoist length sensor may be used directly with the closed form functions for determining the at-rest position of the hook.

Figure 7:
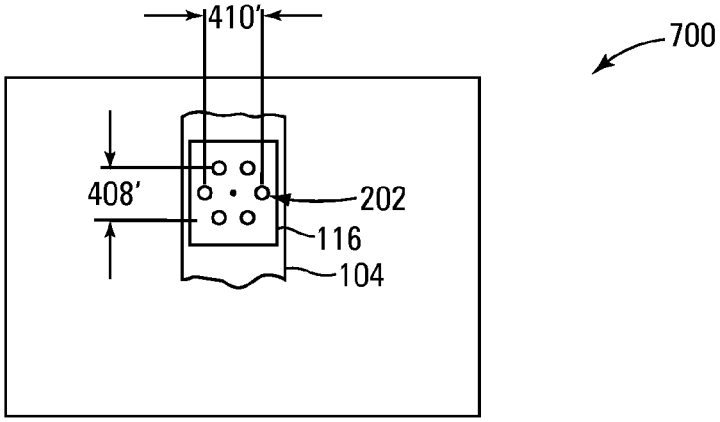
FIG. 7 is a representative view of a camera image according to another embodiment of the present disclosure.

Referring now also to FIG. 7, an image 700 is shown. Image 700 has retro-reflective marker 116 shown. In this image 700, retro-reflective marker 116 is larger in the field of view of the camera 114 than the image of the retro-reflective marker 116 in the field of view of the camera 114 shown in FIG. 4. A measurable dimension of the retro-reflective marker 116 is made for each image. For example, in FIG. 4, a dimension 408 and a distance 410 are determined with respect to specific identifiable individual fiducials 202. The same dimensions with respect to the same fiducials 202 are also measured in FIG. 7 as dimensions 408' and 410'. Given the known distance function, the distance of the camera 114 from the retro-reflective marker 116 may be determined by the size of the fiducial.

One embodiment of the present disclosure determines when a snag condition occurs. A snag condition may occur, as described above, when a hook catches on a load, an obstruction of some sort, infrastructure, rigging, or the like, or when the hook is not fully disconnected from a load that has been moved, for example. In a snag detection operation, embodiments of the present disclosure determine, based on a comparison in the controller 300 of images of the bottom block 104 in its at-rest position to its current position, whether a traverse operation of the crane is displacing the hook 106 from its at-rest position by more than a particular angular displacement. In snag detection, once a difference in position between the at-rest position and the current position of the hook 106 exceeds a certain, settable, angle, traverse motion of the crane in the direction of motion that increases the angular deflection is stopped by the controller. Movement to alleviate the snag, that is, in the direction of motion that decreases the angular deflection, is still allowed. In another embodiment, the controller 300 may, using known functions, determine a velocity or acceleration of displacement from an at-rest position to identify a snag or potential snag condition. In one embodiment, the controller 300 issues an emergency stop command to the crane when a snag condition is detected. Then, once the crane has stopped motion, correction of the snag may be initiated.

Snag detection operation can mitigate but not necessarily completely eliminate hazards associated with snagging, and cannot in all instances prevent a snag. This is, in part, because whether a load is dragged and causes damage depends on a number of factors including but not limited to load height, mass, capability of drives and brakes on the crane, how heavy crane is, and the like.

While a bottom block and hook are shown in the various figures, it should be understood that additional hoisting devices such as magnets, balls, and the like known in the art are amenable for use with the embodiments described herein without departing from the scope of the disclosure.

Embodiments of the present disclosure are compatible with existing variable frequency drives for cranes. Enabling and disabling embodiments of the present disclosure may be accomplished with existing wired or radio pendants. Embodiments of the present disclosure are configured to be retrofitted onto existing hardware platforms, including but not limited to heavy equipment production cranes, primary metals coil cranes, and general purpose single & double girder bridge cranes. Embodiments of the present disclosure may be used in standalone form, or in conjunction with other crane control technology, for example only and not by way of limitation, with Expertoperator™, Safemove™, and Automove™ offered by PaR Systems of Shoreview, Minn.

Figure 8:
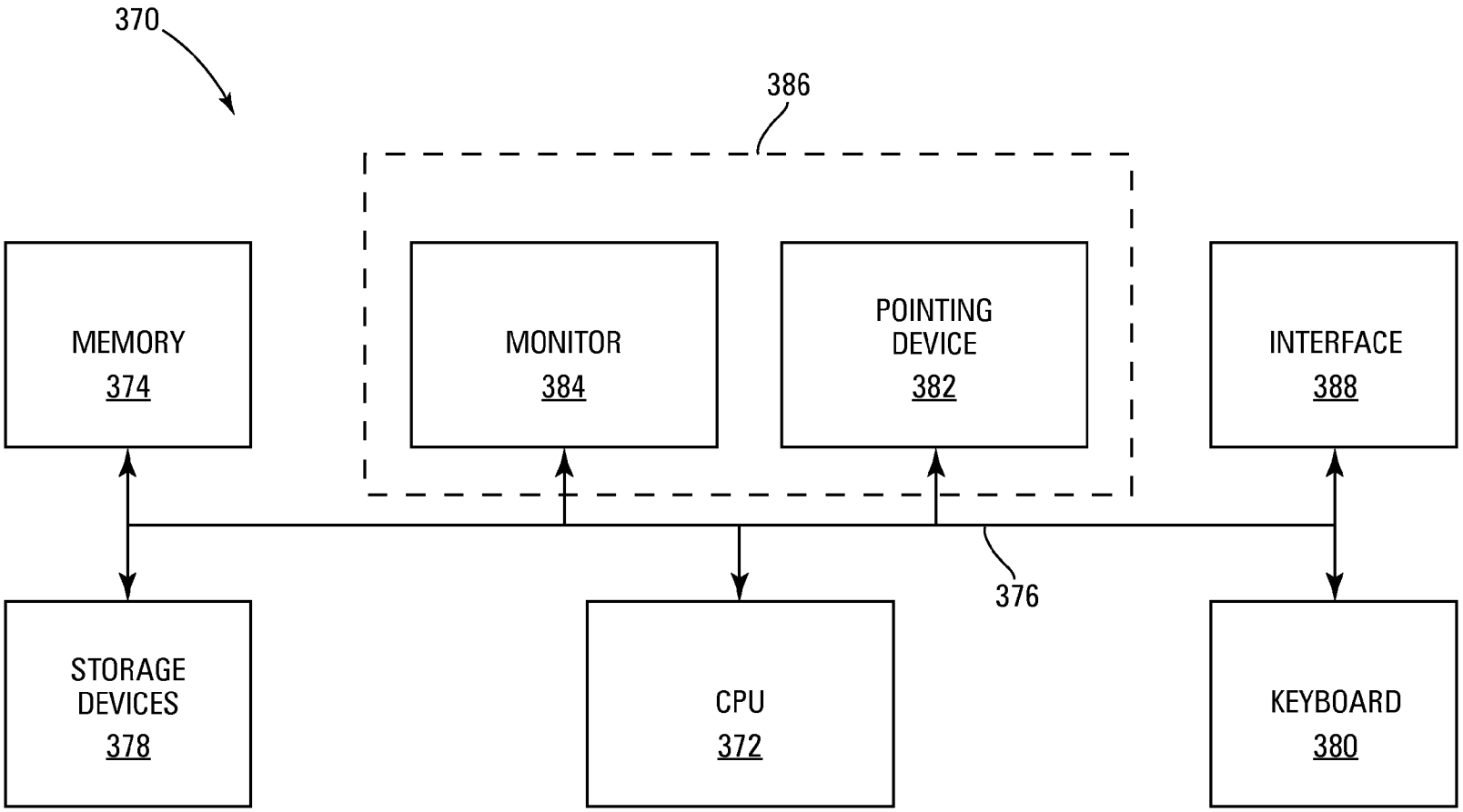
FIG. 8 is a schematic view of a controller on which embodiments of the present disclosure may be practiced.

The system controller such as PLC 300 shown in FIG. 3 and usable on all the hoist systems herein described can comprise a digital and/or analog computer. The logic to implement the control features can be implemented on a PLC with an appropriate input/output configuration. FIG. 8 and the related discussion provide a brief, general description of a suitable computing environment in which the system controller 300 can be implemented. Although not required, the system controller 300 can be implemented at least in part, in the general context of computer-executable instructions, such as program modules, being executed by a computer 370. Generally, program modules include routine programs, objects, components, data structures, etc., which perform particular tasks or implement particular abstract data types. Those skilled in the art can implement the description herein as computer-executable instructions storable on a computer readable medium. Moreover, those skilled in the art will appreciate that the invention may be practiced with other computer system configurations, including multi-processor systems, networked personal computers, mini computers, main frame computers, and the like. Aspects of the invention may also be practiced in distributed computing environments where tasks are performed by remote processing devices that are linked through a communications network. In a distributed computer environment, program modules may be located in both local and remote memory storage devices.

The computer 370 comprises a conventional computer having a central processing unit (CPU) 372, memory 374 and a system bus 376, which couples various system components, including memory 374 to the CPU 372. The system bus 376 may be any of several types of bus structures including a memory bus or a memory controller, a peripheral bus, and a local bus using any of a variety of bus architectures. The memory 374 includes read only memory (ROM) and random access memory (RAM). A basic input/output (BIOS) containing the basic routine that helps to transfer information between elements within the computer 370, such as during start-up, is stored in ROM. Storage devices 378, such as a hard disk, a floppy disk drive, an optical disk drive, etc., are coupled to the system bus 376 and are used for storage of programs and data. It should be appreciated by those skilled in the art that other types of computer readable media that are accessible by a computer, such as magnetic cassettes, flash memory cards, digital video disks, random access memories, read only memories, and the like, may also be used as storage devices. Commonly, programs are loaded into memory 374 from at least one of the storage devices 378 with or without accompanying data.

Input devices such as a keyboard 380 and/or pointing device (e.g. mouse, joystick(s)) 382, or the like, allow the user to provide commands to the computer 370. A monitor 384 or other type of output device can be further connected to the system bus 176 via a suitable interface and can provide feedback to the user. If the monitor 384 is a touch screen, the pointing device 382 can be incorporated therewith. The monitor 384 and input pointing device 382 such as mouse together with corresponding software drivers can form a graphical user interface (GUI) 386 for computer 370. Interfaces 388 on the system controller 300 allow communication to other computer systems if necessary. Interfaces 388 also represent circuitry used to send signals to or receive signals from the actuators and/or sensing devices mentioned above. Commonly, such circuitry comprises digital-to-analog (D/A) and analog-to-digital (A/D) converters as is well known in the art.

Without limitation, some aspects of the disclosure include, snag detection, auto-centering, and hoist prevention on side loading. Further aspects include a crane motion detection system comprising a camera, a fiducial marker, and a controller to process images from the camera to control operation of a crane in side-loading, snagging, and auto-centering situations; and a controller aspect configured to execute computer executable instructions for performing methods of snag detection, auto-centering and side load detection as shown and described herein.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A crane motion detection system, comprising:

a camera configured to mount on a trolley of a crane;

a marker configured to mount on a block of the crane within a field of view of the camera; and a controller coupled to the camera to receive data from the camera, and coupled to the crane to control operation of the crane in response to camera data;

wherein the controller is configured to control operation of at least one of detecting and preventing off center lifts with the block, detecting and preventing snagging of a block, and auto-centering the crane over a block.

2. The crane motion detection system of claim 1, wherein the marker is a fiducial marker.

3. The crane motion detection system of claim 1, wherein the marker is a reflective marker.

4. The crane motion detection system of claim 1, wherein the marker is a pattern.

5. The crane motion detection system of claim 1, wherein the controller is configured to control detecting and preventing off-center lifts with the block by:

detecting a side load condition on a block of the crane; and preventing a hoist operation when the side load condition is detected.

6. The crane motion detection system of claim 5, wherein the controller is further configured to detect a side load condition by determining a displacement of the block of the crane between a known at-rest position of the block and a current position of the block of the crane.

7. The crane motion detection system of claim 6, wherein the controller is further configured to determine a displacement by capturing, with the camera, an image of the block in its current position, and comparing the current position to a known at-rest position of the block.

8. The crane motion detection system of claim 6, wherein the controller is configured to estimate a known at-rest position by determining a distance of the block from the camera by comparing a size of a fiducial marker image associated with the block with results of a mathematical function or functions that relate the distance of the block from the camera to the size of a fiducial marker image associated with the block.

9. The crane motion detection system of claim 6, wherein the controller is configured to estimate the known at-rest position by determining a distance of the block from an image capture element by comparing a size of a fiducial marker image associated with the block with results of a calibration that relates the distance of the block from the image capture element to the size of a fiducial marker image associated with the block.

10. The crane motion detection system of claim 9, wherein the calibration is obtained using a mathematical function or functions related to a size of the fiducial marker image at two known distances from the image capture element.

11. The crane motion detection system of claim 1, wherein the controller is configured to prevent a hoist operation when a displacement of a block of the crane between a known at-rest position of the block and a current position of the block exceeds a predetermined threshold.

* * * * *